US006475122B2

(12) United States Patent
Wu

(10) Patent No.: US 6,475,122 B2
(45) Date of Patent: Nov. 5, 2002

(54) STATIONARY BIKE

(75) Inventor: Mu-Chuan Wu, Tainan Hsien (TW)

(73) Assignee: Tonic Fitness Technology, Inc., Tainan Hsien (TW)

( * ) Notice: Subject to any disclaimer, the term of this patent is extended or adjusted under 35 U.S.C. 154(b) by 78 days.

(21) Appl. No.: 09/801,798

(22) Filed: Mar. 9, 2001

(65) Prior Publication Data

US 2002/0128123 A1 Sep. 12, 2002

(51) Int. Cl.[7] ..... A63B 22/06
(52) U.S. Cl. ..... 482/57; 482/64
(58) Field of Search ..... 482/1–9, 51, 57, 482/60, 63–65, 900–902

(56) References Cited

U.S. PATENT DOCUMENTS 5,050,865 A * 9/1991 Augspurger et al. ..... 482/2
5,762,584 A * 6/1998 Daniels ..... 482/75
5,944,638 A * 8/1999 Maresh et al. ..... 482/63

* cited by examiner

*Primary Examiner*—Glenn E. Richman
(74) *Attorney, Agent, or Firm*—Bacon & Thomas, PLLC

(57) ABSTRACT

A stationary bike includes a first shaft, a second shaft and third shaft, two pedal rods fixed on the first shaft, a first transmitting wheel and a flywheel fixed on the first shaft, a second, a third, a fourth and a fifth transmitting wheel fixed on the second shaft. The second and the third one are fixed thereon with a one-way bearing, and the fourth and the fifth transmitting wheel are fixed firmly thereon, with the fifth one connected with the flywheel with a moving member. A sixth and a seventh transmitting wheel are fixed on the third shaft, with the sixth one connected with the third one with a moving member and with a one-way bearing. The seventh and the fourth transmitting wheel engage with each other to rotate in the opposite direction Then the flywheel a always rotates clockwise in spite of clockwise or counterclockwise rotation of the pedal rods. And a resisting device with a generator may be affixed beside the flywheel to generate power to supply to the stationary bike.

2 Claims, 3 Drawing Sheets

STATIONARY BIKE

BACKGROUND OF INVENTION

This invention relates to a stationary bike, particularly to one having a flywheel always rotating clockwise whether in clockwise pedaling or in counterclockwise pedaling, and if a resisting device with a generator is affixed with the flywheel, it can generate power to supply the stationary bike to use.

Conventional fitness equipment, for example, stationary bikes, has its flywheel rotate only during clockwise pedaling, but during counterclockwise pedaling the flywheel will gradually stop by inertia and then begin to rotate counterclockwise, forming conditions of fast clockwise rotation to slow rotation, then to stop rotation, then slow counterclockwise rotation to final fast counterclockwise rotation. Even if a resisting device with a generator is provided on the stationary bike and rotates with the flywheel, the power generated will be not stable, changing incessantly and even stop so that the stationary bike may have weak power or no power at all, letting instruments using power such as an indicator, an instrument controller stop operation.

SUMMARY OF THE INVENTION

The objective of the invention is to offer a stationary bike improved in the drawback mentioned above, keeping the flywheel always rotate in clockwise direction, and thus permitting the generator driven by the flywheel generate always normally to supply to the stationary bike to use

BRIEF DESCRIPTION OF DRAWINGS

This invention will be better understood by referring to the accompanying drawings, wherein.

DETAILED DESCRIPTION OF THE PREFERRED EMBODIMENT

Figure 1:
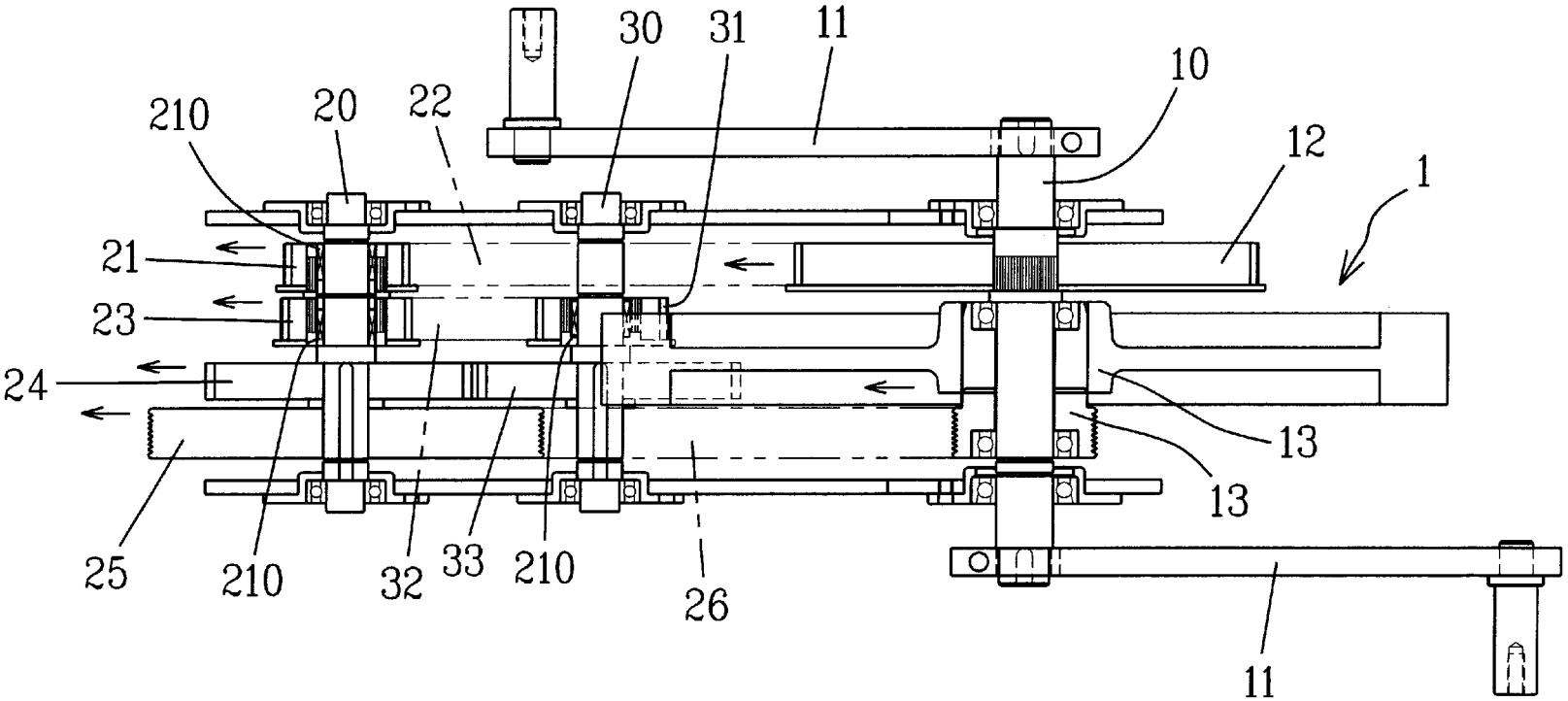
FIG. 1 is an upper view of a stationary bike being pedaled clockwise in the present invention.
Figure 2:
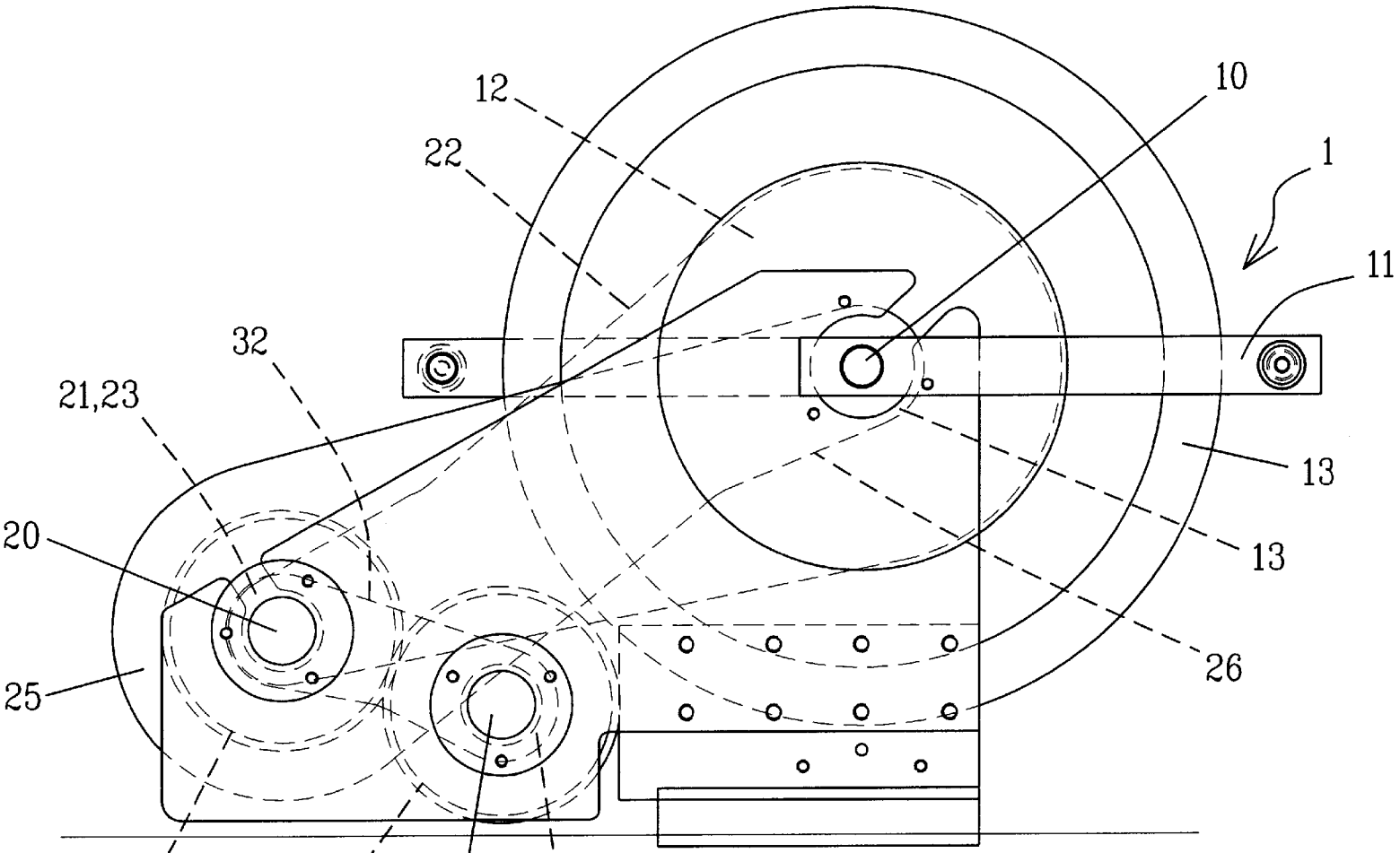
FIG. 2 is a side view of the stationary bike in the present invention.

A preferred embodiment of a stationary bike in the present invention, as shown in FIGS. 1 and 2, includes a frame 1, a first shaft 10, a second shaft 20 and a third shaft 30, two pedal rod 11, a first transmitting wheel 12, a flywheel 13, a second transmitting wheel 21, a third transmitting wheel 23, a fourth transmitting wheel 24, a fifth transmitting wheel 25, a sixth transmitting wheel 31, a seventh transmitting wheel 33, a first moving member 22, a second moving member 26, a third moving member 32 and a one-way bearing combined together.

The first shaft 10 is combined on the frame 1, having two pedal rods 11 fixed at two sides to rotate the first shaft 10 by pedaling . The first transmitting wheel 12 is fixed firmly on the first shaft 10 to rotate together, and the flywheel 13 is fixed on the first shaft 10 inside the first transmitting wheel 12 with a bearing fitted in an inner hole of the flywheel 13. A resisting device with a generator is positioned side by side to the flywheel 13 so that the generator may rotate to generate power by rotation of the flywheel 13 to supply power to the stationary bike.

The second shaft 20 is combined on the frame 1 on an opposite side of the first shaft 10, and the second transmitting wheel 21 is fixed on the second shaft 20 in line with the first transmitting wheel 12, with a one-way bearing 210 fitted between the second shaft 20 and the second transmitting wheel 21. Then when the second transmitting wheel 21 is rotated clockwise, the second shaft 20 also rotates in the same (clockwise) direction. On the contrary, when the second transmitting wheel 21 is rotated counterclockwise, the second shaft 20 is immovable, and a first moving element 22 (such as a belt) is connected to the first transmitting wheel 12. Further, the third, the fourth hand the fifth transmitting wheel 23, 24 and 25 are orderly located beside the second transmitting wheel 21. The second and the third transmitting wheel 23 are fitted on the second shaft with the same one-way bearing, and connected with each other firmly to rotate together. The fourth and the fifth transmitting wheel 24 and 25 rotate together with the second shaft 20, and the fifth transmitting wheel 25 is connected with the flywheel 13 of the first shaft 10 with a second moving member 26 (such as a belt).

The third shaft 30 is fixed on the frame 1, located in a space between the first and the second shaft 10 and 20, as shown in FIG. 2. The sixth transmitting wheel 31 is fixed on the third shaft 30, positioned in line with the third transmitting wheel. A reverse one-way bearing 210 is deposited between the sixth transmitting wheel 31 and the third shaft 30, so the third shaft 30 is immovable when the sixth transmitting wheel rotates clockwise. But the third shaft 30 will rotate counterclockwise when the sixth transmitting wheel 31 rotates counterclockwise. In addition, a third moving member (such as a belt) 32 is connected with the third transmitting wheel 23, and the seventh transmitting wheel 33 is fixed on the third shaft 30, engaging by means of teeth with the fourth transmitting wheel 24 fixed on the second shaft 20.

After the stationary bike is assembled as shown in FIG. 1, pedaling the pedal rods 11 may bring the first shaft 10 rotate clockwise, and then the first transmitting wheel 12 may rotate also-clockwise (or normal rotation).

The first transmitting wheel 12 transmits to the second transmitting wheel 21 on the second shaft 20 by means of the moving element 22. The second shaft 20 rotates clockwise by the rotation of the second transmitting wheel 21 owing to the one-way bearing 210, and then the fourth transmitting wheel 24 and the fifth transmitting wheel 25 both fixed on the second. shaft 20 may rotate synchronously. But the fourth transmitting wheel 24 engages with the seventh transmitting wheel 33 fixed on the third shaft 30, so the third shaft 30 may rotate counterclockwise, and the fifth transmitting wheel 25 rotates the flywheel 13 clockwise as the flywheel 13 is connected with the fifth transmitting wheel 25 with the second moving member 26. And the transmitting order begins from the first shaft 10 to the first transmitting wheel 12, then to the second transmitting wheel, then to the second shaft 20, then to the fifth transmitting wheel 25, and then to the flywheel 13.

If a resisting device with a generator is provided beside the flywheel 13 then the generator may generate power to supply to the stationary bike, and that is to self-supply power. Though the third transmitting wheel 23 is connected with the sixth transmitting wheel 31 by the third moving member 32, the third transmitting wheel 23 rotates together with the second transmitting wheel 21, but at this time the sixth transmitting wheel 31 may not drive the third shaft 30 rotate clockwise because of the sixth. transmitting wheel connected with the third shaft with the reverse one-way bearing. In spite of the fourth transmitting wheel 24 producing counterclockwise rotation to the seventh transmitting wheel 33 and then to the third shaft 30, the reverse rotation of the third shaft 30 does not affect normal rotation of the flywheel 13

Figure 3:
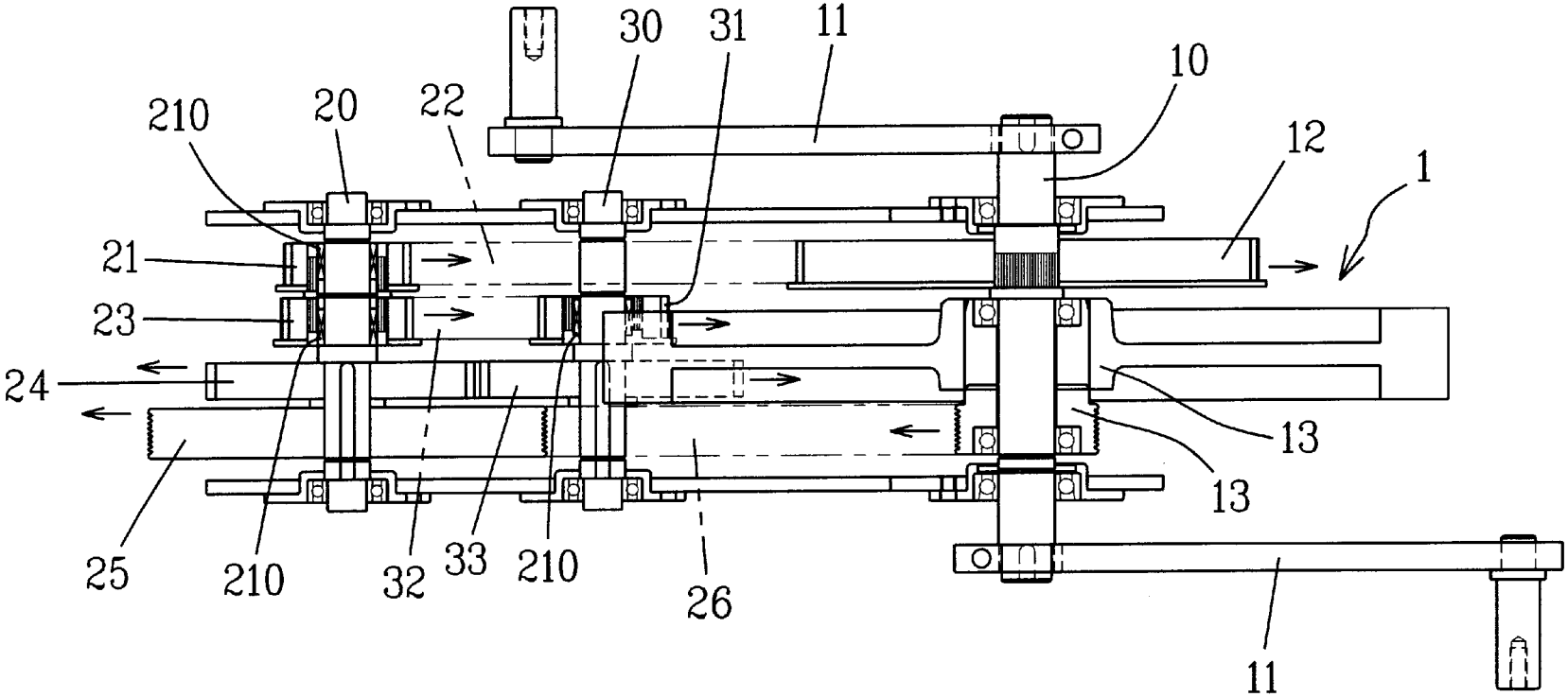
FIG. 3 is an upper view of the stationary bike pedaled counterclockwise in the present invention.

In pedaling backward, the pedal rods 11 make the first shaft 10 rotate counterclockwise and then the first transmitting wheel 12 do the same. The second transmitting wheel 21 and the third transmitting wheel 13 both also rotate counterclockwise because the first transmitting wheel transmits the second transmitting wheel 21 on the second shaft 20 with the moving member 22. Next, the third transmitting wheel 23 transmits the sixth transmitting wheel 31 by means of the moving member 32 to let the sixth transmitting wheel 31 produce counterclockwise rotation, with the third shaft 30 also rotating counterclockwise owing to the one-way bearing fixed in the sixth transmitting wheel 31 Then the seventh transmitting wheel 33 on the third shaft 30 also rotates counterclockwise, forcing the fourth transmitting wheel 24 on the second shaft 20 rotates clockwise, due to its engaging with the seventh transmitting wheel 33. Then the second shaft 20 also rotates counterclockwise, getting the fifth transmitting wheel thereon also rotates clockwise, and the fifth transmitting wheel 25 connected with the flywheel 13 rotates the flywheel 13 clockwise, as shown in FIG. 3 in which those steps are drawn. The transmitting order begins from the first shaft 10 to the first transmitting wheel 12, then to the second transmitting wheel 21, then to the third transmitting wheel 23, then to the sixth transmitting wheel 31, then to the third shaft 30, then to the seventh transmitting wheel 33, then to the fourth transmitting wheel 24, then to the fifth 11 transmitting wheel 25 and finally to the flywheel 13.

As understood from the aforesaid description, the flywheel 13 can. always rotate clockwise, no matter the pedal rods may be pedaled clockwise or counterclockwise, not as the conventional stationary bike has its flywheel gradually stops by inertia and then begins to rotate counterclockwise. Then a resisting device with a generator can keep power always generated for use, evidently improved the drawback of the conventional stationary bike.

While the preferred embodiment of the invention has been described above, it will be recognized and understood that various modifications may be made therein and the appended claims intended to cover all such modifications that may fall within the spirit and scope of the invention.

I claim:

1. A stationary bike comprising:

a first shaft fixed on a frame, having a pedal rod respectively fixed at two sides of said first shaft, a first transmitting wheel fixed firmly on said first shaft to rotate together, and a flywheel fixed on said first shaft beside said first transmitting wheel:

a second shaft fixed on said frame and located opposite to said first shaft, having a second transmitting wheel in line to said first transmitting wheel, a one-way bearing fitted between said second transmitting wheel and said second shaft to keep said second transmitting wheel in place, said second shaft rotating clockwise in case of said one-way bearing rotating clockwise, said second shaft being immovable in case of said one-way bearing rotating counterclockwise; said transmitting wheel connected to said first transmitting wheel by means of a moving member; a third, a fourth and a fifth transmitting wheel fixed orderly of said second shaft, said third transmitting wheel and said second transmitting wheel fitted on said second shaft with the same one-way bearing and fixed with each other to rotate together, said fourth and said fifth transmitting wheel rotating together with said second shaft, and said fifth transmitting wheel connected to said flywheel fixed on said first shaft:

a third shaft also fixed on said frame and located in a space between said first and said second shaft, a sixth transmitting wheel fixed on said third shaft in line to said third transmitting wheel on said second shaft, a one-way bearing fitted between said sixth transmitting wheel and said third shaft to keep said sixth transmitting wheel in place, said third shaft being immovable in case of said one-way bearing rotating clockwise; said third shaft rotating counterclockwise in case of said one-way bearing rotating counterclockwise; further, a seventh transmitting wheel fixed on said third shaft and engaging with said fourth transmitting wheel on said second shaft so as to let said seventh and said fourth transmitting wheel rotate in opposite direction:

said flywheel always rotating clockwise whether said pedal rods are rotated clockwise or counterclockwise, without need of waiting said flywheel stop gradually with inertia and then said pedal rods rotated counterclockwise.

2. The stationary bike as claimed in claim 1, wherein a resisting device with a generator is fixed beside said flywheel to generate power to supply to said stationary bike.

* * * * *